United States Patent [19]

Szatkowski, deceased

[11] 4,015,544

[45] Apr. 5, 1977

[54] DISPOSABLE PALLET

[75] Inventor: Richard R. Szatkowski, deceased, late of Westmont, Ill., Richard X. Szatkowski, administrator

[73] Assignee: Richard X. Szatkowski

[22] Filed: Apr. 24, 1975

[21] Appl. No.: 571,061

[52] U.S. Cl. ..... 108/51.3; 428/132

[51] Int. Cl.[2] ..... B65D 19/34

[58] Field of Search ..... 108/51–58; 229/23 AB, DIG. 9; 206/386; 248/346; 428/132, 133

[56] References Cited

UNITED STATES PATENTS

| | | | |
|---|---|---|---|
| 2,888,221 | 5/1959 | Connelly | 108/56 |
| 2,908,464 | 10/1959 | Traudt et al. | 108/56 |
| 2,925,978 | 2/1960 | Marso | 108/56 |
| 2,996,276 | 8/1961 | Sorensen et al. | 108/57 |
| 3,055,624 | 9/1962 | Wilson | 108/58 |
| 3,272,158 | 9/1966 | Barnum | 108/51 |
| 3,362,867 | 1/1968 | Wilkins | 428/132 |
| 3,520,258 | 7/1970 | Shepherd | 108/51 X |
| 3,557,719 | 1/1971 | Gielas | 108/51 X |

*Primary Examiner*—James T. McCall
*Assistant Examiner*—William E. Lyddane
*Attorney, Agent, or Firm*—Dorsey L. Baker

[57] ABSTRACT

A lightweight pallet having at least two sheets of flat material combined to provide a loading deck with supporting legs. The supporting legs are formed from the sheet material and comprise two panels cut from each sheet hingedly depending downwardly along a score line and adhesively interlocked in a manner to define a four-sided leg.

13 Claims, 8 Drawing Figures

DISPOSABLE PALLET

BACKGROUND OF THE INVENTION

This invention relates to pallets upon which materials are stacked for storage and transportation. A large portion of pallets presently used for this purpose are formed of wood and have top and bottom decks joined by wooden runners. Their construction permits entry of truck forks between the runners for lifting and transporting the loads. Various attempts have been made to form pallets out of other materials for the primary purpose of reducing costs.

The prior cost reduction developments have usually necessitated a corresponding reduction in strength. However, the instant invention is believed to provide a pallet of the lowest possible cost while maximixing its strength and durability. Accordingly, it includes one or more of the following characteristics:

a. capable of manufacture solely from lightweight sheet material such as corrrugated board and an adhesive;

b. legs comprised of panels formed directly from the loading deck and interlocked in a manner capable of supporting large loads;

c. capable of being nested so as to minimize shipping and storage space when not in use; and d. capable of manufacture by a simple, fully automatic process, requiring no substantial tooling expense.

SUMMARY OF THE INVENTION

In order to provide a pallet having one or more of the above characteristics, the instant invention includes at least two layers of flat sheet material. Supporting legs for the pallet are formed from these layers by cutting two adjacent panels from each layer and folding them downwardly along transversely disposed parallel score lines. Prior to such folding, the layers are stacked and rotated 90° to each other such that the parallel score lines of the top layer are perpendicular to those of the lower layer and the panels of each layer are in vertical juxtaposition. Then upon downward folding of the panels, a four-sided leg is formed and bonded in place. Various methods of supporting or reinforcing the legs will be subsequently disclosed.

Accordingly, it is an object of my invention to provide a lightweight pallet having one or more of the above described characteristics. It is a further object of my invention to provide a pallet which has a very high strength to weight ratio. Another object is to provide a pallet in which the sheet materials can be pre-cut, shipped to the user in flat sheets and simply assembled.

DESCRIPTION OF THE DRAWINGS

The manner in which these and other objects are obtained can be understood with reference to the following specifications and drawings in which.

DETAILED DESCRIPTION

Figure 1:
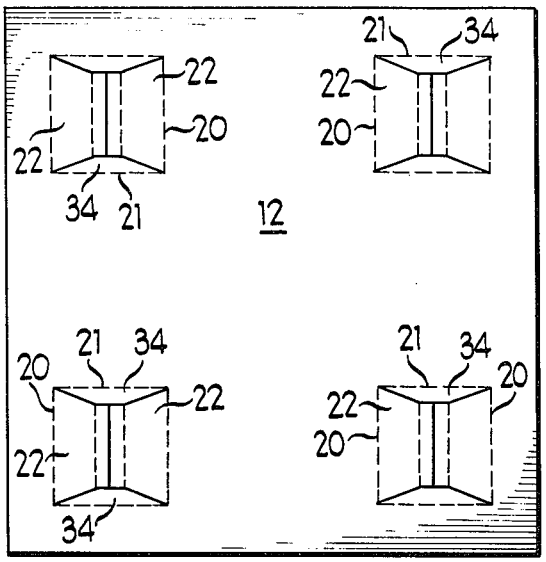
FIG. 1 is a plan view of sheet material having the cuts and scores desired for forming a preferred embodiment of my invention.
Figure 2:
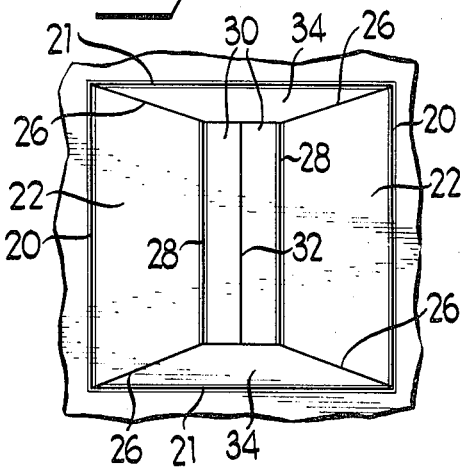
FIG. 2 is an enlarged plan view of a portion of FIG. 1, disclosing the supporting legs in greater detail.
Figure 5:
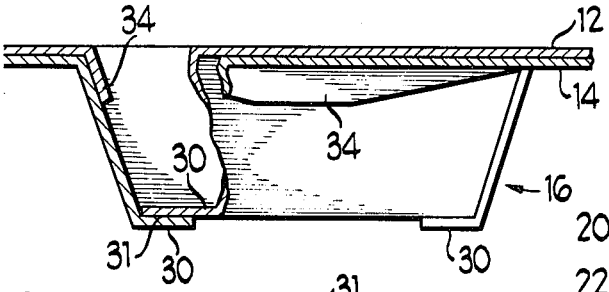
FIG. 5 discloses a side elevational view of a support leg of the preferred embodiment with portions broken away.

The basic compound of a preferred embodiment of my invention is depicted in FIG. 1. It depicts the upper sheet 12 of semi-rigid material such as corrugated board, fiberboard, corrugated plastic sheets or similar material. In this sheet are cuts and scores defining foldable panels which, in conjunction with identical panels from a second sheet comprise the supporting legs 16 of a pallet. These foldable panels preferably comprise two primary panels 22 and two reinforcing panels 34 both of which preferably take the shape of an isosceles trapezoid. Each of the primary panels 22 is defined by cut lines 26 at each side, a score line 20 which hinges the panel to the sheet material and by another score line 28 parallel to line 20. Score line 28 hingedly connects the primary panel to a rectangular panel 30, each of these panels being separated from each other by a cut 32. As subsequently shown, each primary panel of the disclosed embodiment is folded downwardly at an angle of approximately 70° from the horizontal (See FIG. 5) to define one side of a four-sided leg 16. The rectangular panels 30 are then folded along score line 28 parallel to the sheet material 12 to form an interlock between the primary panels.

The reinforcing panels 34 also take the appearance of an isosceles trapezoid. They are formed by score lines 21 which hingedly connects them to the sheet material, and by cut lines 26. It should be noted that score or hinge lines 20 and 21 together form a square, and that two sheets, having panels identically formed, may be stacked one upon the other such that the squares of one are vertically juxtaposed upon the squares of the other sheet.

Sheet material having the described panel structure forms the principle component of my invention. In its manufacture, the sheet material is fed into a die which makes the cuts and score lines for the number of legs desired for the pallet, the number being dependent upon pallet size and load. After the leg patterns are thus formed, the flat sheet may be assembled or shipped to a customer's plant for assembly.

Figure 3:
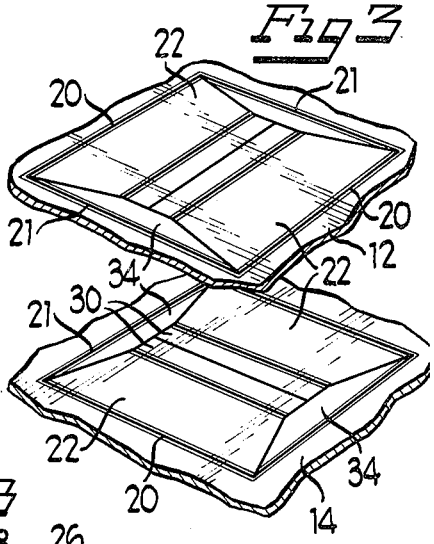
FIGS. 3 and 4 depict the steps of assembly of my invention.
Figure 4:
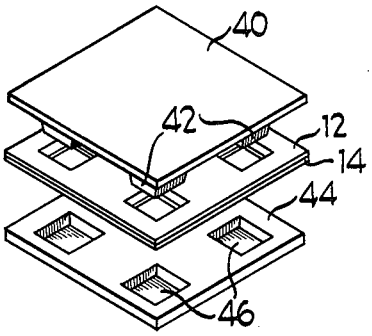

As depicted in FIGS. 3 and 4, assembly merely requires that two sheets be rotated 90° relative to one another such that the cut and score lines of one sheet are perpendicular to the same cut and score lines of the other sheet. Any conventional adhesive for the sheet material utilized is applied to the top surface of the bottom sheet 14, and the two sheets are stacked for bonding. Prior to curing of the adhesive, the sheets are passed into a die having a top section 40 with appropriately spaced projections 42 in the shape of an inverted obelisk and a bottom section 44 having mating cavities 46. As the die section 40 reciprocates downward, the primary and reinforcing panels are pushed downwardly resulting in a square aperture in the sheet and the supporting leg depicted in FIGS. 6 and 7.

Figure 6:
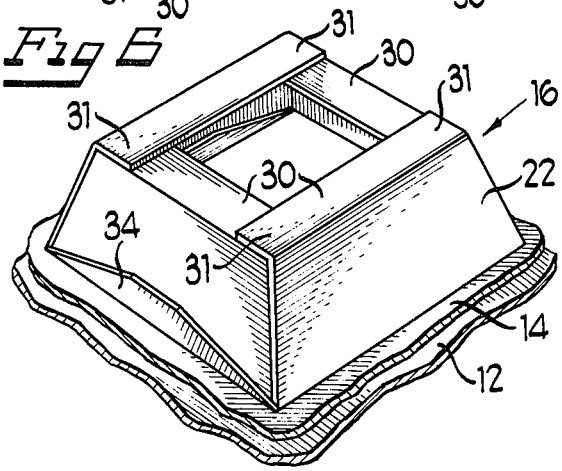
FIG. 6 discloses a perpsective view of a supporting leg of my invention as viewed from the bottom.
Figure 7:
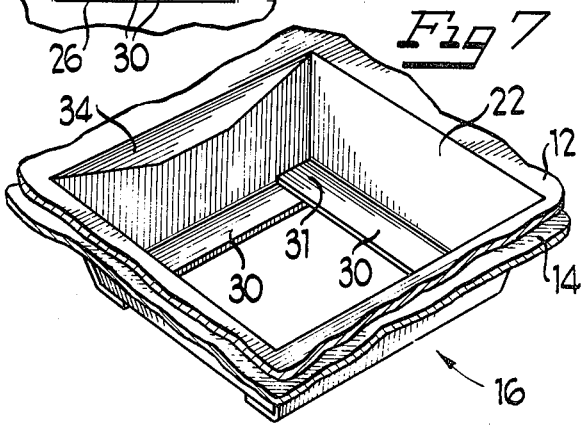
FIG. 7 discloses a perspective view of a supporting leg as viewed from above.

As shown in these FIGS., the primary panels 22 of the upper sheet are essentially perpendicular to those of the lower sheet. The resulting structure is a four-sided leg, each side being an isosceles trapzoid. Further, the bottom of each leg 16 is interconnected by the overlap 31 of the reactangular panels 30 which were folded into a horizontal position by the bottom of cavity 46 of the female die section upon reciprocation of the die. The adhesive applied to the upper surface of sheet 14 bonds the rectangular panels together in the area 31 of the overlap. Such provides excellent strength and rigidity in that collapse would require a compression failure of the rectangular panel 30 or the associated primary panel 22. Further strength is applied by the reinforcing panels 34. As shown in FIGS. 6 and 7, a separate reinforcing panel 34 is bonded to each primary panel, two on the inside surfaces of leg 16 and two on the outside surfaces. If corrugated board is used, the outer paper plies of the panels 34 and 22 act as the flanges of a beam separated by two corrugated plies to provide resistance of bending forces applied to each side of leg 16.

An important aspect of my invention is that the primary panels 22 are a part of and integrally attached to the sheet material. This eliminates separate attachment of the leg 16 which would provide only surface interconnection.

My invention may take various forms. The pallet may comprise more than two sheets with alternating sheets being rotated 90° to one another. Thus, a pallet according to this invention might have 6, 8 or more plies giving substantial loading capacity both to the deck and the legs. Alternatively, one or more top plies of sheet material without the panels may be subsequently applied to provide a smooth top deck.

Figure 8:
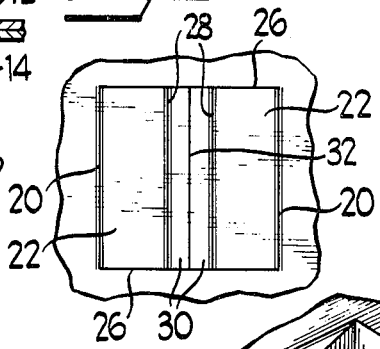
FIG. 8 is an alternative embodiment illustrating the supporting leg structure of my invention.

With the obelisk structure of the legs as shown, the pallets can easily be stacked. Alternatively, the legs could be straight by omitting the reinforcing panels 34 and making the primary panels 22 rectangular as shown in FIG. 8. Finally, separate material such as foam could be molded in the legs for further reinforcement, or additional adhesive and board could be used. While the supporting leg structure forming legs 16 requires substantially square sections of sheet material, the pallets need not be. With proper selection or utilization of the dies, pallets of rectangular or other configurations may be used.

I claim:

1. A pallet comprising:
a. at least two sheets of flat material bonded together to form a loading deck and supporting legs;
b. each of said legs comprising two primary panels formed in each sheet and folded downwardly to define a square aperture in said deck, said panels of each sheet being folded about parallel hinge lines, the hinge lines of the panels of one sheet being perpendicular to those of the other; and
c. said primary panels having extensions at their bottom edge which are folded parallel to said deck, said extensions overlapping and being bonded together in the area of said overlap.

2. A device as recited in claim 1 in which said primary panels have the shape of an isosceles trapezoid.

3. A device as recited in claim 2 in which said sheets include reinforcing panels in the shape of an isosceles trapezoid adjacent said primary panels and are bonded thereto.

4. A load bearing pallet comprising:
a. at least two flat sheets of material bonded together for carrying a load and having depending legs for supporting said pallet and said load;
b. each of said legs comprising two primary panels formed from each of said sheets and hingedly connected to said sheets and folded downwardly to form a four-sided leg; and
c. said primary panels having rectangular panels connected along their bottom edge, said rectangular panels being folded parallel to said sheets and bonded to one another.

5. A load bearing pallet comprising:
a. a first sheet of material having at least two adjacent panels in said sheet of equal area and folded downwardly about transversely disposed parallel fold lines to define a single aperture;
b. a second sheet of material having at least two adjacent panels in said sheet of equal area and folded downwardly about transversely disposed parallel fold lines to define a single aperture;
c. said sheets being stacked one upon the other such that said fold lines of said first sheet being perpendicular to those of the second sheet; and
d. said panels depending downwardly and meeting along their vertical edges and joined together to define a multi-sided leg for said pallet.

6. A device as recited in claim 5 in which said panels comprise isosceles trapezoids and said fold line is the base thereof.

7. A device as recited in claim 5 in which:
a. each of said panels has a rectangular panel connected along its bottom edge, said rectangular panels of said first and second sheets overlapping and attached to one another.

8. A load bearing pallet comprising:
a. at least two sheets of flat material bonded together to form a load bearing surface and having depending legs for supporting said load and said sheets; and
b. said legs comprising two primary panels formed in each sheet folded downwardly about a score line, said sheets and panels juxtaposed to define a multi-sided leg for said pallet, said legs including smaller panels formed in each sheet and bonded to the primary panels of the juxtaposed sheet.

9. A device as recited in claim 8 in which said primary panels define a trapezoid whose base comprises said score line.

10. A device as recited in claim 8 in which each primary panel carries a rectangular panel at its bottom edge, said rectangular panels being overlapped and bonded together in the area of said overlap.

11. A method of manufacturing a pallet comprising the steps of:
a. forming at least two primary panels in each of at least two sheets of flat material, said panels of each pallet being foldable downwardly about parallel score lines to define a single aperture;
b. placing an adhesive on a surface of one of said sheets of flat material;
c. stacking another of said sheets of flat material in contact with said adhesive of said one sheet such that the score lines of said sheets are perpendicular to one another and intersect at the ends; and
d. pushing said panels downwardly below the plane of said sheets inserted in its place to bond said sheets together and to form a four-sided supporting leg.

12. A pallet comprising:
a. at least two sheets of material affixed to one another to define a loading deck;
b. supporting legs comprising two primary panels in the shape of a trapezoid formed from each sheet and folded downward about parallel hinge lines to define a single aperture the hinge lines of the panels of one sheet being perpendicular to those of another; and c. said primary panels having extensions along their bottom edge folded parallel to said deck, said extensions overlapping and affixed to one another.

13. A method of making a load bearing structure comprising:

a. cutting and scoring a plurality of sets of panels in at least two sheets of material, said panels of each set being adjacent one another the same size and foldable downwardly in opposite directions about transversely disposed parallel fold lines to define an aperture in each of said sheets;

b. stacking said sheets one upon the other such that the panels are in juxtaposition; and c. pressing said panels of said sheets downward through the plane of said sheets to form vertical supporting legs for said sheets and folding a portion of said panels to overlay a portion of another panel for affixing one portion to the other.

* * * * *